United States Patent [19]

Pearson

[11] 4,383,640

[45] May 17, 1983

[54] HEAT CONTROL DEVICE FOR A WOOD OR COAL BURNING STOVE

[76] Inventor: Paul W. Pearson, P.O. Box 7, Westville, Ind. 46391

[21] Appl. No.: 330,520

[22] Filed: Dec. 14, 1981

[51] Int. Cl.[3] ..... F23N 3/04

[52] U.S. Cl. ..... 236/11; 236/10

[58] Field of Search ..... 236/11, 10, 45, 46 E; 126/77

[56] References Cited

U.S. PATENT DOCUMENTS

| | | | |
|---|---|---|---|
| 1,813,732 | 7/1931 | Freeman | 236/11 |
| 1,905,977 | 4/1933 | Adams | 236/10 |
| 2,369,681 | 2/1945 | Miles | 236/10 |
| 4,074,854 | 2/1978 | Kamper | 236/11 |

*Primary Examiner*—William E. Tapolcai

*Attorney, Agent, or Firm*—James D. Hall

[57] ABSTRACT

A heat control device for a stove which burns solid fuel and in which the heat output of fuel combustion is regulated in order to control within preselected temperature ranges the temperature of the combustion chamber of the stove and the ambient air temperature of the environment being heated by the stove.

5 Claims, 2 Drawing Figures

HEAT CONTROL DEVICE FOR A WOOD OR COAL BURNING STOVE

BACKGROUND OF THE INVENTION

Desirable features of a heat generating system, particularly one which is used to heat a structure, include reasonable:

1. control over thermal output,
2. means to transfer thermal output to the environment to be heated,
3. operational safety,
4. operational efficiency, and
5. operational convenience.

Solid fuel burning stoves as thermal generating devices have been deficient in most, if not all, of the above features because it is very difficult to control the combustion rate of their fuel. This is due to the fact that, once ignited, most solid fuel fires, when provided with sufficient oxygen, tend to be self-propagating. The more the fuel burns, the more it tends to create conditions favorable to more intense burning, limited only by the availability of fuel or oxygen. Control of the combustion process can be established by limiting the supply of oxygen to the fire; however, to maintain the stove's temperature within a range of approximately 200 degrees Fahrenheit to 400 degrees Fahrenheit necessary for safe and efficient operation, the operator must constantly monitor the stove's performance and make adjustments of the air intake accordingly.

If flue gas temperatures are allowed to fall below 200° F. when wood is used as a fuel, creosote which is a flammable byproduct of low temperature combustion begins to accumulate on the inner surface of the flue and chimney, creating a potential fire hazard. If temperatures are allowed to exceed 400° F., potentially useful heat is wastefully vented into the atmosphere in large quantities and the exhaust components of the stove may overheat to produce a potential fire hazard.

Other problems with solid fuel burning stoves are regulating the thermal output within the optimal temperature range to meet specific heat demands and the transfer of heat to desired locations. Again these can be controlled if the operator is willing to constantly monitor the performance of the stove and ambient air temperature of the structure, and make adjustments accordingly. Monitoring of the stove and the environment temperatures on the continuous basis required for the safe and efficient operation of the system is obviously not a practical alternative for most solid fuel stove users.

SUMMARY OF THE INVENTION

This invention relates to a heat control device for a wood or coal burning stove which regulates, within preselected limits, the heat output of the stove and the transfer of the heat produced by the stove to the heated environment. The invention utilizes temperature sensors to sense the temperature of the environment being heated by the stove and the temperature of the combustion chamber of the stove and uses this information (1) to regulate the combustion air input into the combustion chamber of the stove, thereby controlling the temperature within the chamber, and (2) to control the movement of a heat transfer medium in heat transfer relationship with the stove and within the environment being heated, thereby controlling the temperature of the heated environment. This is accomplished in a manner such that both the temperature of the stove and the environment being heated by the stove remain within prescribed limits at all times.

Accordingly, it is an object of this invention to maintain the combustion chamber of the stove within temperature limits which have been determined to minimize the probability that its operation will present a significant fire hazard to the environment in which it is located.

Another object of this invention is to maintain, within selected limits, the temperature of the environment being heated by a wood or coal burning stove.

Still another object of this invention is to reduce the overall fuel consumption of the stove by reducing the combustion rate of the fuel within the stove to a safe minimum level at times when the environment being heated by the same does not require additional heat input to maintain its temperature at the preselected level.

Still another object of this invention is to provide the operator of the stove with a means of automatically regulating its performance, thus reducing the time and effort generally needed to monitor and regulate the same.

Yet another object of this invention is to provide an effective and efficient means of transferring heat generated by a wood or coal burning stove to the environment which is to be heated.

Other objects of this invention will become apparent upon the reading of the following description.

DESCRIPTION OF THE DRAWINGS

A preferred embodiment of this invention has been chosen for purposes of illustration and description wherein.

DESCRIPTION OF THE PREFERRED EMBODIMENT

Figure 1:
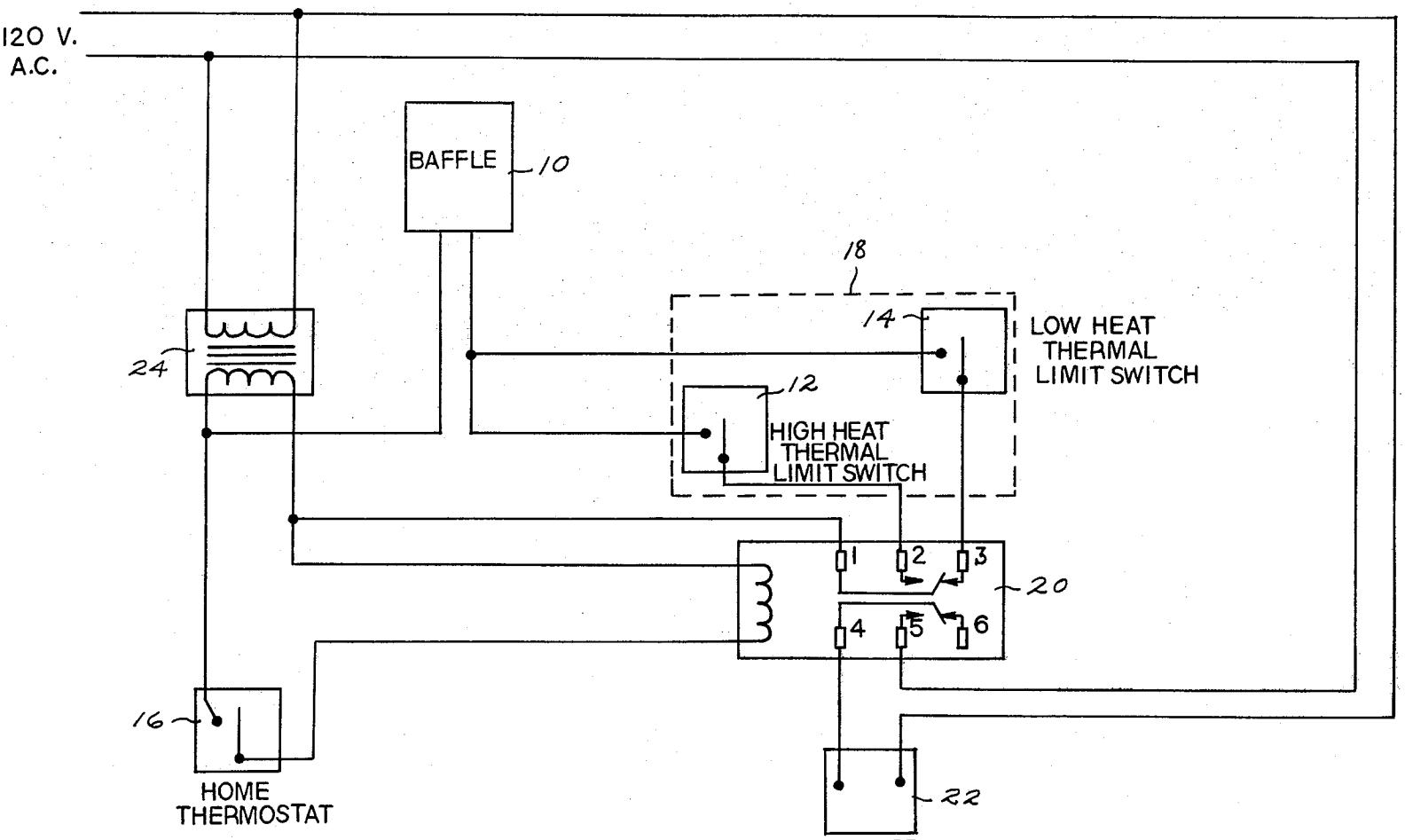
FIG. 1 is a schematic view of the control device showing one operative mode with the stove in a no-demand heat producing mode.

The preferred embodiment illustrated is not intended to be exhaustive or to limit the invention to the precise form shown. It is chosen and described in order to best explain the principles of the invention and its practical use to enable others skilled in the art to best utilize the invention.

The heat control device of this invention is adapted for use in conjunction with a stove which consumes a solid form of fuel, such as wood or coal, and whose combustion chamber is sealable except for an air inlet, which may be regulated, and an exhaust gas outlet. The device includes a motorized baffle 10 which is connected into the duct system for the stove so as to regulate the air intake into the stove combustion chamber 18 (illustrated by broken lines). Preferably, the baffle is located within the combustion air inlet duct into the stove combustion chamber, although it could be located in the flue duct of the combustion chamber. The control device also includes a pair of thermal limit switches 12 and 14 and a thermostat 16. Thermal limit switches 12 and 14 are set to open and close between specific temperature limits and are connected to the stove combustion chamber 18 or its flue duct component in a manner so as to sense the internal heat within the combustion chamber formed by the burning of the wood or coal. In an actual model of the invention, switch 12, known as the high heat thermal limit switch, was adapted to operate between the upper limit of 325° F. and the lower limit of 285° F.; and switch 14, known as the low heat thermal limit switch, was adapted to operate between an upper limit of 250° F. and the lower limit of 210° F. A double pole, double throw relay 20 interconnects switches 12 and 14 with the power source for baffle 10 and the power source for prime mover 22. Prime mover 22, as shown in the figures, is a motor driven blower which will be utilized in hot air heating systems. In a hot water heating system, the prime mover may be a pump. In situations where heat transfer can be satisfactorily accomplished through radiation and natural convection and where the heat loss of the structure in which the stove is located exceeds the heat output of the stove when the stove is functioning in the low heat output mode, the prime mover may be dispensed with entirely. However, it is anticipated that the prime mover will be needed in most applications to achieve satisfactory results. Thermostat 16, which is mounted on a wall of the room or structure to be heated by the stove, serves to connect the power source to the coil of relay 20. When 120 volt A.C. household current is utilized to power the control device, a step-down transformer 24 will be used as shown to provide a low A.C. voltage, such as 24 volts to operate all components except the prime mover 22, in order to minimize the potential of a hazardous electrical shock to the operator.

Figure 2:
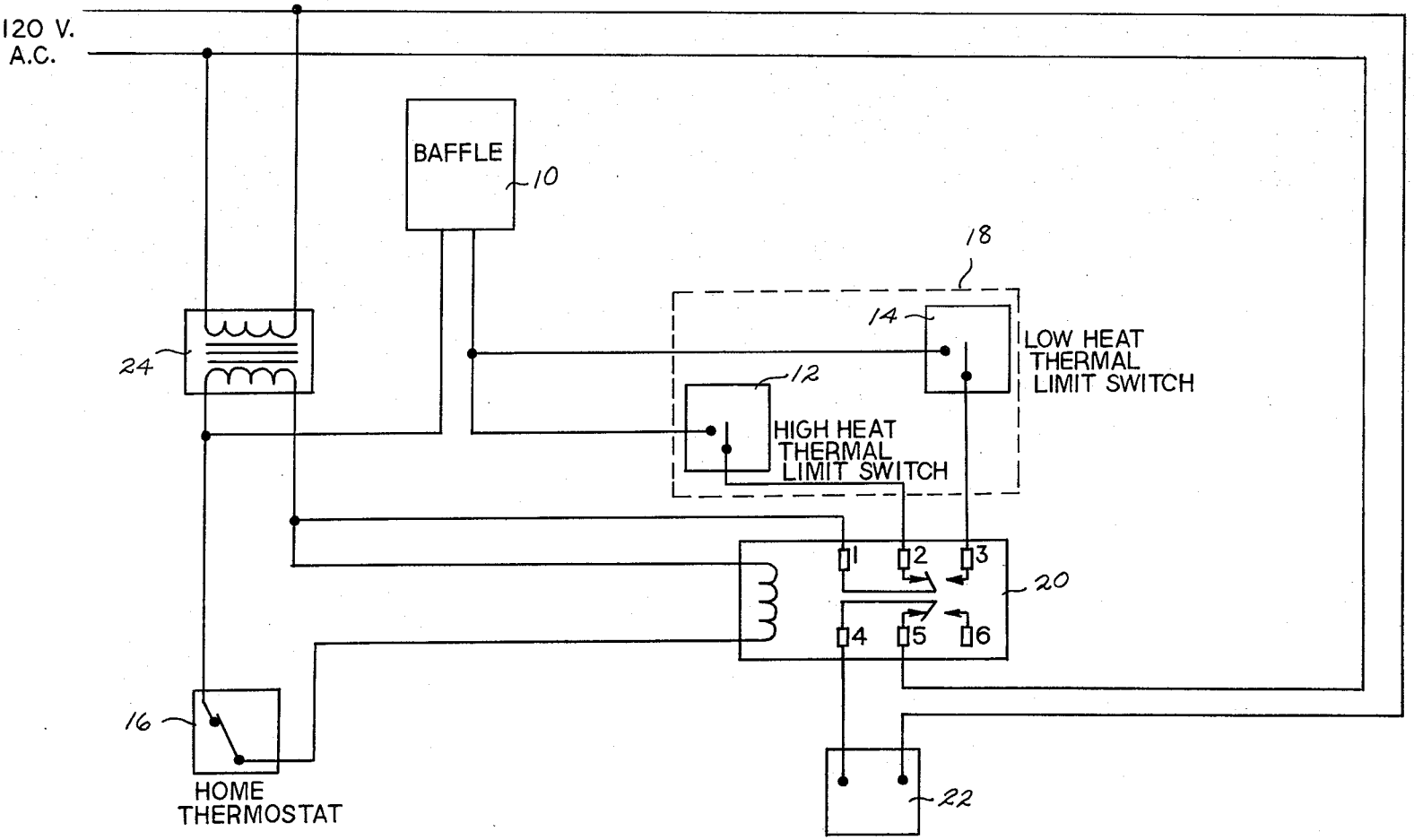
FIG. 2 is a schematic view of the control device shown in a second operative mode with the stove in a demand heat producing mode.

During a period of heat demand, that is when the ambient air temperature within the room or structure falls below a specific temperature, the thermostat 16 will close, as shown in FIG. 2, causing the energizing of the coil of relay 20. As relay 20 is energized, terminals 1 and 2 are connected and terminals 4 and 5 are connected in the relay. When terminals 1 and 2 are connected, a circuit is completed through high heat limit switch 12 and the motor of baffle 10. When terminals 4 and 5 are connected, a circuit is completed between the power source and prime mover 22, thus activating prime mover 22. Activation of prime mover 22 causes the heat transfer medium, such as air when the prime mover is a blower, to be circulated after passing in heat transfer relationship around combustion chamber 18 of the stove. The temperature of the combustion chamber is actively monitored by switch 12. With switch 12 open, as shown in FIG. 2, baffle 10 closes or severely restricts the air inlet into the combustion chamber 18 of the stove. At its lower temperature limit, switch 12 closes to activate the motor of baffle 10, which opens the baffle within the air inlet duct to allow combustion air to enter combustion chamber 18 of the stove. As the heat within the combustion chamber increases due to an increased oxygen supply, and the upper temperature limit of switch 12 is reached, switch 12 opens to deactivate the motor of baffle 10. This allows the baffle to close, thereby cutting off or severely restricting the air intake into the combustion chamber to reduce the combustion or burning temperature of the fuel within the stove. As long as thermostat 16 is in the heat demand mode, the position of baffle 10 within the air inlet will be regulated by switch 12, thereby maintaining the burning temperature of the fuel within combustion chamber 18 at specific high temperature levels.

When the room or building temperature, as sensed by thermostat 16, reaches its desired upper limit, the thermostat opens to cause the coil in relay 20 to be de-energized (see FIG. 1). Upon the de-energizing of its coil, relay 20 causes terminal 1 to be disconnected from terminal 2 and connected with terminal 3, and terminal 4 to be disconnected from terminal 5 and connected with terminal 6. Terminal 6 of the relay is a "dead" or unused terminal. When terminal 1 is put into contact with terminal 3 of the relay, low heat thermal limit switch 14 is placed into circuit with the motor of baffle 10. When terminal 4 is connected with terminal 6, prime mover 22 is disconnected from its power source and is thus deactivated. Switch 14 now will serve to actively monitor the temperature of combustion chamber 18 of the stove. The purpose of switch 14 is to provide just enough oxygen to the fuel within the stove to maintain its burning temperature just above the range where creosote is readily formed while minimizing heat output in order to reduce fuel consumption. Baffle 10 will be normally closed to reduce or entirely restrict the flow of combustion air into the combustion chamber when switch 14 is open or in its upper temperature limit. As the heat of combustion in chamber 18 is reduced through the lack of adequate combustion air, switch 14 will close at its lower temperature limit to cause activation of the motor for baffle 10 to allow combustion air through the inlet and to enter the combustion chamber to increase the burning rate of the fuel. This opening and closing of baffle 10, in response to the upper and lower temperature limits of switch 14, will maintain a controlled low heat burning rate of the fuel during those periods of the stove's operation in which there is no demand for heat within the room or building structure. When, once again, thermostat 16 closes in response to a lower room temperature and calls for additional heat within the room, relay 20 will be energized to disconnect switch 14 and to connect switch 12 with the motor of baffle 10, and reconnect prime mover 22 with its power source for activation. As the cyclical demand for heat within the room continues, switches 12 and 14 at different heat levels will alternately control the operation of baffle 10.

It is recognized that the circuits involving the motor of baffle 10 and the thermal limit switches may be replaced by a position control servomechanism responsive to thermal sensors which quantitatively or qualitatively varies the signal energy applied to the position controller in response to changes in thermal input to the sensors.

It is to be understood that the invention is not to be limited to the details given above, but may be modified within the scope of the appended claims.

What I claim is:

1. A heat control device for a wood and coal burning stove having a combustion chamber where wood or coal is burned, a combustion air inlet into said combustion chamber, said control device comprising means for regulating the flow of combustion air from said air inlet into said combustion chamber, a high heat thermal sensing means and a low heat thermal sensing means in heat transfer relationship with said combustion chamber for sensing the temperature thereof, said combustion air regulating means being responsive to either of said thermal sensing means by reducing the amount of combustion air into said combustion chamber when either sensing means approaches its upper temperature limit while connected to the regulating means, a thermostat means for sensing ambient temperature, means responsive to said thermostat means for connecting said high heat thermal sensing means to said combustion air regulating means when the thermostat means senses a low specified ambient temperature wherein the combustion air into said combustion chamber is regulated between specific high temperature limits sensed by said high heat thermal sensing means, said connecting means also connecting said low heat thermal sensing means to said combustion air regulating means when the thermostat means senses a high specified ambient temperature wherein the combustion air into said combustion chamber is regulated between specific low temperature limits sensed by said low heat thermal sensing means.

2. The control device of claim 1 wherein said connecting means for the sensing means includes a relay responsive to the opening and closing of said thermostat.

3. The control device of claim 2 wherein said high heat thermal sensing means causes said combustion air regulating means at approximately 325° F. to reduce the amount of combustion air into the combustion chamber and causes said combustion air regulating means at approximately 285° F. to increase the amount of combustion air into the combustion chamber.

4. The control device of claim 3 wherein said low heat thermal sensing means causes said combustion air regulating means at approximately 250° F. to reduce the amount of combustion air into the combustion chamber and causes said combustion air regulating means at approximately 210° F. to increase the amount of combustion air into the combustion chamber.

5. The control device of claim 1 and a mover for circulating a heat transfer medium warmed by said combustion chamber, said thermostat means for activating said mover between said low and high specified ambient temperatures.

* * * * *